United States Patent [19]

Drost et al.

[11] 4,190,881

[45] Feb. 26, 1980

[54] CROSSARM ASSEMBLY FOR HIGH INTENSITY DISCHARGE LUMINARIES

[75] Inventors: James L. Drost; Myron K. Gordin, both of Oskaloosa, Iowa

[73] Assignee: Muscatine Lighting Manufacturing Co., Muscatine, Iowa

[21] Appl. No.: 905,276

[22] Filed: May 12, 1978

[51] Int. Cl.[2] ..... F21V 21/14

[52] U.S. Cl. ..... 362/250; 362/238; 362/239; 362/241; 362/247; 362/263; 362/396; 362/431

[58] Field of Search ..... 362/238, 239, 249, 241, 362/250, 247, 396, 263, 431

[56] References Cited

U.S. PATENT DOCUMENTS 2,530,912 11/1950 Secofsky et al. ..... 362/250 X

*Primary Examiner*—Stephen J. Lechert, Jr.

*Attorney, Agent, or Firm*—Rudolph L. Lowell; G. Brian Pingel

[57] ABSTRACT

A preassembled and prewired crossarm assembly of high intensity discharge luminaries mountable on a light pole. The assembly includes an elongate, tubular bar that is supported on a ballast-receiving box attachable to the light pole so that the weight of the ballast box is centered on the pole. Members are employed for adjustably mounting the luminaries from the tubular bar in a spaced apart relation. Each mounting member has a wire-receiving passage means in communication with the interior of the tubular bar and an associated luminary, and aligned openings are formed in the bar and the ballast box for the disposition of electrically conductive wiring that connects the luminaries to the ballasts.

3 Claims, 4 Drawing Figures

CROSSARM ASSEMBLY FOR HIGH INTENSITY DISCHARGE LUMINARIES

SUMMARY OF THE INVENTION

The present invention provides a crossarm assembly of high intensity discharge luminaries that is preassembled and prewired at the factory to facilitate on-site installation. The luminaries are each adjustably mounted from a tubular rod by means that have wire-receiving passages in communication with the interior of the tubular rod and an associated luminary. The tubular rod is supported on a ballast receiving box in which ballasts for each of the luminaries are stored, and electrically conductive wiring is disposed through the passages in the mounting means and the interior of the tubular rod for electrically connecting the luminaries to the ballasts. Thus, all electrical wiring of the assembly is contained internally therein and the sole electrical connection that must be made in installing the assembly at an on-site location is the connection of an external supply of power to a power inlet on the ballast box.

A pair of releasable mounting means are employed to secure the ballast box of the assembly to the pole in a centered relation therewith. Accordingly, the weight of the box and the ballasts and other components contained therein is carried entirely by the pole and by the tubular rod from which the luminaries are mounted. As a result, the luminaries are the only elements supported by such rod whereby to minimize the bending torque exerted on the rod, especially during periods of high winds.

DESCRIPTION OF THE PREFERRED EMBODIMENT

Figure 1:
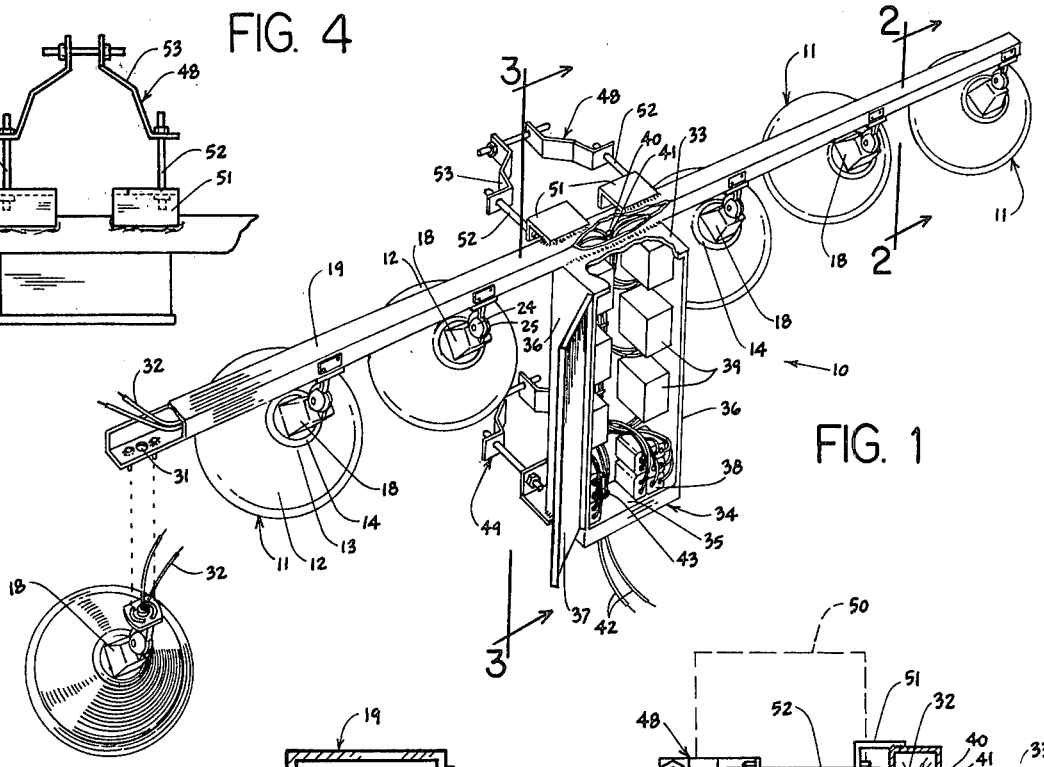
FIG. 1 is a rear perspective view of a preferred embodiment of the light assembly of the present invention, with a portion broken away and exploded for clarity.

The present invention provides a light assembly, shown generally at 10 in FIG. 1, of high intensity discharge luminaries 11 that is mountable on a light pole alone or in a stacked arrangement with other similar assemblies to provide light for various types of outdoor recreational facilities.

Figure 2:
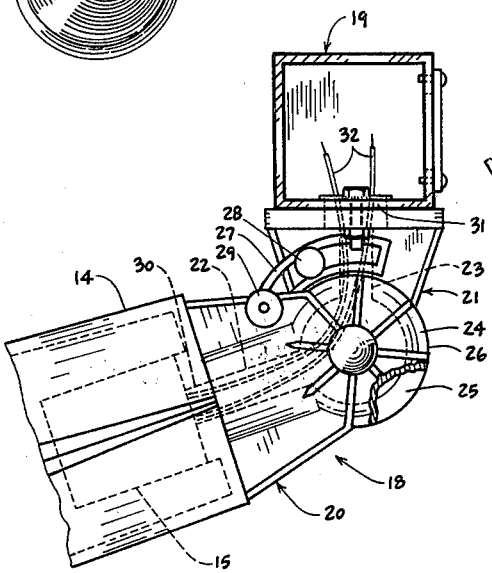
FIG. 2 is an enlarged sectional view taken on line 2—2 of FIG. 1.

The luminaries 11 each include a truncated cone or dished type reflector 12 with the small end 13 attached to the periphery of a hollow base portion 14. As indicated in FIG. 2, an electrical socket 15 is secured in each of the base portions 14 for receiving a high intensity discharge lamp such as mercury vapor, metal halide, or high or low pressure sodium lamps. The base portions 14 are bolted to one end of mounting members 18, that are in turn bolted to an elongated tubular rod 19 serving as a crossarm for the assembly 10.

Each of the mounting members 18 is formed of two sections 20 and 21 that, respectively, have wire receiving axial passages 22 and 23, and overlapping dish shaped knuckle portions 24 and 25 bolted together to form a hollow knuckle joint 26 that permits the section 20 to pivot relative to the section 21. A slotted guide track 27 is bolted at 28 to one side of the mounting member section 21, and a spring loaded pin 29 is disposed through the mounting member section 20 for engaging the guide track 27 to limit the pivotal movement between the sections 20 and 21. The passage 22 in the mounting member section 20 is axially in line with an aperture 30 in an associated base portion 14, and the passage 23 is axially in line with one of a plurality of longitudinally spaced apart apertures 31 in the bottom of the crossarm 19. Accordingly, electrical wiring 32 that is connected to each of the lamp sockets 15 is run through the passages 22 and 23 and the hollow knuckle joint 26 into the interior of the tubular crossarm 19.

Figure 3:
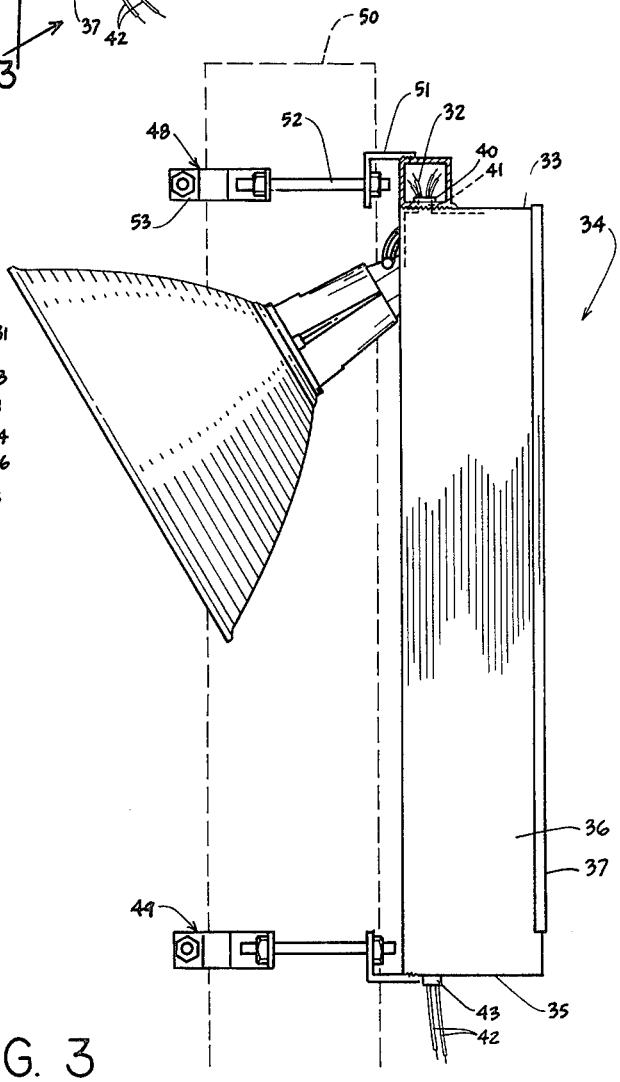
FIG. 3 is an enlarged sectional view taken on line 3—3 of FIG. 1.

Referring to FIGS. 1 and 3, the crossarm 19 is medially fixed, as by welding, to the top end 33 of a ballast-receiving box 34 that also has a bottom end 35, three fixed sidewalls 36, and a door 37 that is hinged to one of the sidewalls 36 to serve, when closed, as a fourth sidewall of the box 34. A plurality of capacitors 38 and ballasts or transformers 39 are disposed in the box 34, with one of each associated with one of the luminaries 11. A port 40 formed in the top end 33 of the box 34 is aligned with a medial opening 41 in the bottom of the crossarm 19 to form a passageway for running the electrical wiring 32 into the box 34 for connection to the output sides of the capacitors 38 and ballasts 39. To complete the prewired electrical circuitry for the assembly 10, input wiring 42 may be run through a port 43 in the box bottom end 35 for connection to the input sides of the capacitors 38 and ballasts 39.

Figure 4:
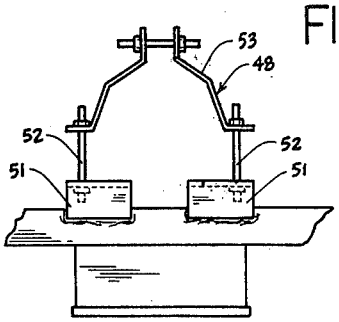
FIG. 4 is a fragmentary plan view of the assembly of FIG. 1.

A pair of pole clamps 48 and 49 are included as part of the assembly 10 for releasable attachment thereof to a light pole 50, shown only in FIG. 3. The clamp 48 has a pair of angle iron bracket portions 51 (FIGS. 1, 3 and 4) welded to the top of the crossarm 19 and connected by bolt and nut units 52 to an expandible outer strap 53. The clamp 49 is constructed similar to the clamp 48 but is attached at the bottom end 35 of the ballast box 34. Thus, the assembly 10 is mountable on the light pole 50 by the clamps 48 and 49 with the ballast box 34 centered on the pole 50 so that the weight of the box 34 and the enclosed capacitors 38 and ballasts 39 is not in any way supported by the crossarm 19. As a result, only the luminaries 11 are supported by the crossarm 19, so as to substantially reduce the bending torque exerted on the connection of the crossarm 19 to the ballast box 34, especially during periods of high winds.

The assembly 10 can be completely preassembled and prewired at the factory prior to shipment to on-site locations. Accordingly, installation of the light assembly 10 at an on-site location, simply requires the steps of mounting the assembly 10 on the light pole via the mounting clamps 48 and 49, connecting the input wiring 42 to a source of electrical energy, and then raising the pole into an upright position for support from a pole base. In some instances the assembly 10 is elevated directly by a crane or the like to a mounting position on the pole. Only the exterior connections of the input wiring 42 is required during the entire installation procedure. Furthermore, due to the unitary construction of the assembly 10, the particular lighting requirements needed to satisfactorily illuminate a facility can be achieved by installing on the light pole one or more of the assemblies 10 in a stacked relationship.

Thus, the present invention provides a light assembly that is readily installable and is completely versatile for meeting a wide variety of lighting requirements.

We claim:

1. A preassembled and prewired crossarm assembly of spaced apart high intensity discharge luminaries mountable on a light pole, said assembly comprising:

(a) a ballast-receiving box having a top side, a bottom side, and four side walls to form an enclosure having a wire receiving aperture in one of said sides, (b) a plurality of ballasts for said luminaries contained in said ballast box, (c) an elongated tubular bar having a medial portion fixed to at least said one side of said ballast box, said bar formed with a wire receiving aperture in alignment with the aperture in said one side of said box, (d) means for adjustably mounting said luminaries on said tubular bar, each of said mounting means having a wire-receiving passage means in communication with the interior of said tubular bar and an associated luminary, (e) electrically conductive wire means disposed through the passage means of said mounting means, the interior of said tubular bar and the aligned apertures of said bar and said box for electrically connecting said luminaries to said ballasts, and (f) means for releasably securing said ballast box to said light pole with at least one side of said ballast box adjacent said pole so that the weight of said box and the ballasts enclosed therein is centered on said pole.

2. A preassembled and prewired crossarm assembly according to claim 1 wherein said mounting means for said luminaries each includes:

(a) a first section attached to one of said luminaries having a first wire receiving passage formed therein and a first knuckle portion;

(b) a second section attached to said tubular rod having a second wire receiving passage formed therein and a second knuckle portion, and (c) means interconnecting said first and second knuckle portions for relative adjustable movement of said first and second sections.

3. A preassembled and prewired crossarm assembly according to claim 1 wherein said means for securing said ballast box to said light pole includes:

(a) a pair of expandible clamps connectible with the ballast box adjacent the top and bottom sides thereof.

* * * * *